US005647619A

United States Patent [19]

DeLisio

[11] Patent Number: 5,647,619

[45] Date of Patent: Jul. 15, 1997

[54] AUTOMOBILE TRUNK LOCK TIE-DOWN

[75] Inventor: Dennis M. DeLisio, Steger, Ill.

[73] Assignee: Pyramid Industries Ltd., Steger, Ill.

[21] Appl. No.: 668,576

[22] Filed: Jun. 21, 1996

[51] Int. Cl.[6] ..... E05C 19/18

[52] U.S. Cl. ..... 292/288; 292/262

[58] Field of Search ..... 292/339, 288, 292/262; 24/301, 302, 197

[56] References Cited

U.S. PATENT DOCUMENTS

| | | | |
|---|---|---|---|
| 357,597 | 2/1887 | Hazelton | 24/197 |
| 2,618,497 | 11/1952 | Gardels | 292/288 |
| 2,919,946 | 1/1960 | Miener | 292/288 |
| 2,973,217 | 2/1961 | Gregoire | 292/288 |
| 4,191,413 | 3/1980 | Barner | 24/302 X |
| 4,666,194 | 5/1987 | Charman | 292/288 |
| 4,667,993 | 5/1987 | Hannesson et al. | 292/339 |
| 5,063,641 | 11/1991 | Chuan | 24/197 |
| 5,297,828 | 3/1994 | Chung | 292/262 X |
| 5,325,568 | 7/1994 | Bruhm | 24/301 |

FOREIGN PATENT DOCUMENTS

| | | | |
|---|---|---|---|
| 9408 | 9/1927 | Australia | 24/197 |
| 166334 | 1/1950 | Australia | 24/197 |
| 567345 | 2/1924 | France | 24/197 |
| 310096 | 3/1937 | Italy | 24/301 |

*Primary Examiner*—Rodney M. Lindsey
*Attorney, Agent, or Firm*—Don Moyer

[57] ABSTRACT

The new tie down has a triangular link which can be removably attached to a trunk lock latch in place of the trunk lock strike, has cinch rings encircled through the link, has a strap adjustably attached through the cinch rings, and has a hook attached to the strap and removably attachable to the trunk lock strike so that the trunk lid can be easily and reliably tied down while carrying an oversize load.

1 Claim, 1 Drawing Sheet

AUTOMOBILE TRUNK LOCK TIE-DOWN

BACKGROUND OF THE INVENTION

This invention attaches between an automobile trunk lock strike and trunk lock latch in order to tie down the automobile trunk lid while carrying an oversize load.

People often carry oversize loads in an automobile trunk which keep the trunk lid open and unlatched. For this reason various ad hoc straps, ropes, and elastic cords are typically used to tie down the unlatched trunk lid. These ad hoc devices are not easy to attach, ale not easy to remove, are not easy to adjust, and are not reliable to withstand the large forces which can be encountered in use.

Devices shown in prior art have similar opportunities for improvement. Miener in U.S. Pat. No. 2,919,946 and Gregoire in U.S. Pat. No. 2,973,217 show devices which attach between structural elements of the automobile trunk lid and the rear of the automobile. Because of variations in the manufacture of automobiles the attachments to the structural elements are not easy and require awkward manipulations.

Gardels in U.S. Pat. No. 2,618,497 shows a rigid bar attached between the trunk lock latch and strike. This device is not adjustable and can not work with today's locks. Charman in U.S. Pat. No. 4,666,194 shows an adjustable strap attached between the latch and strike. This device has many parts which must be awkwardly manipulated in use and which would be difficult to manufacture at low cost if the parts am to be reliable for the large forces which can act on the device. This device will also interfere with the remote controlled trunk lock openers and trunk lock sensors now common on automobiles.

Thus, there is an opportunity to make a tie down which is easy to attach, which is easy to adjust, which is easy to manufacture, which is reliable, and which is low in cost.

SUMMARY OF THE INVENTION

Objects of this invention include the following. Make a tie down which is easily and reliably attachable to the latch and strike of most automobile trunk locks. Make a tie down which is easily and reliably adjustable in length. Make a tie down which is strong enough to withstand the large forces which can be encountered in use. Make a tie down which has few parts. Make a tie down which is easy to manufacture at low cost.

In Summary, one embodiment of this invention has a link which is removably attachable into an automobile trunk lock latch in place of a trunk lock strike, has two cinch rings encircled through the link, has a strap which is adjustably attached to the link through the cinch rings, and has a hook which is attached to the strap and which can be removably attached to the lock strike.

Other equivalent embodiments will be comprehended in the detailed description of the drawings, which will make additional equivalent embodiments obvious to people skilled in the art.

DRAWING FIGURES

DETAILED DESCRIPTION OF THE DRAWINGS

Figure 1:
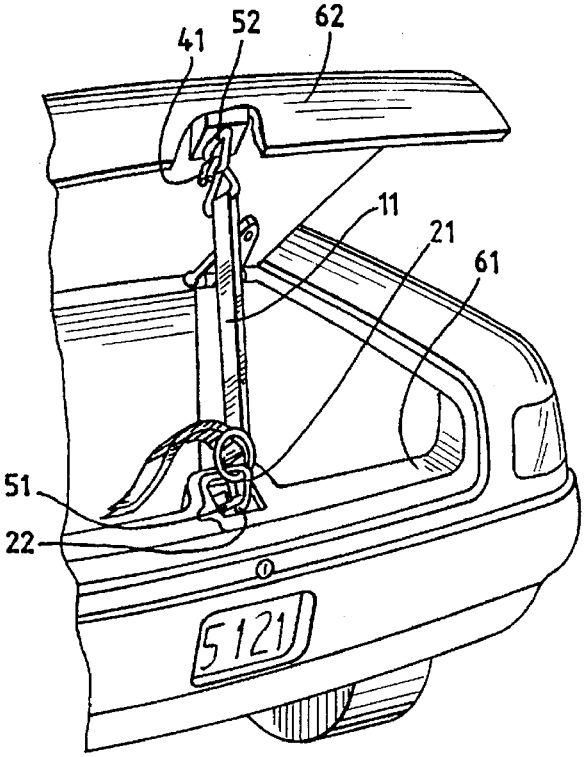
FIG. 1 shows the new tie-down in use on an automobile which has the trunk lock latch in the trunk body.
Figure 2:
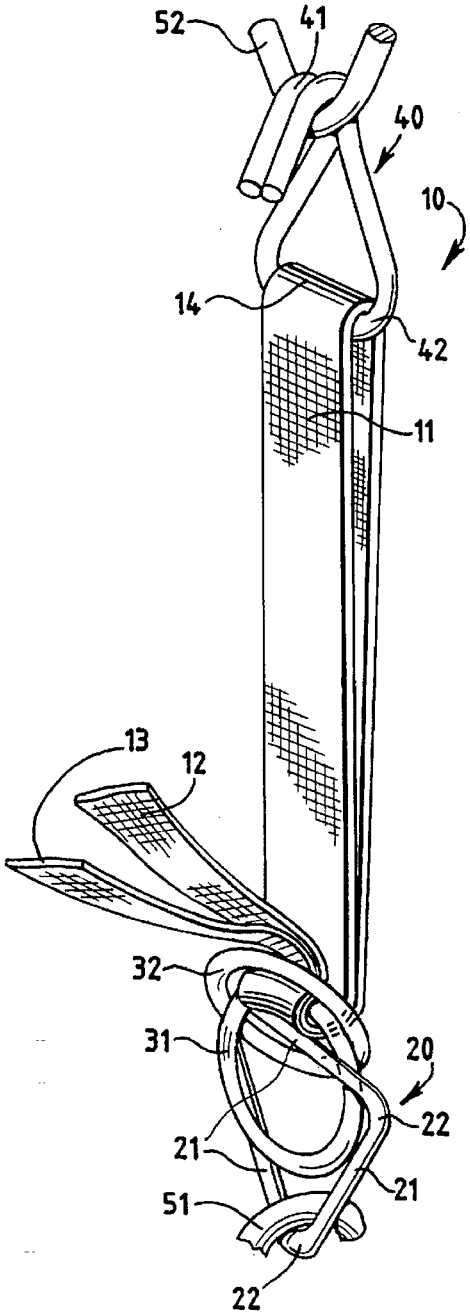
FIG. 2 shows details of the new tie-down in use in the manner shown in FIG. 1.
Figure 3:
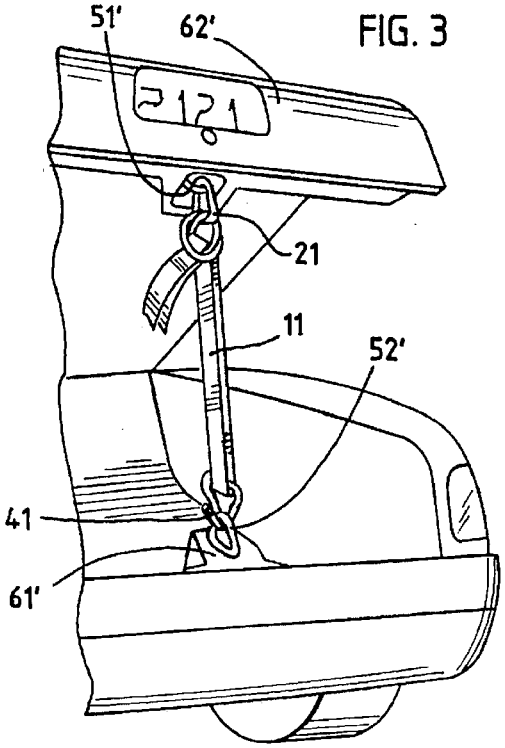
FIG. 3 shows the new tie-down in use on an automobile which has the trunk lock strike in the trunk body.

Details of the new tie-down 10 ate seen best in FIG. 2. A link 20 has a periphery which is generally in the form of an isosceles triangle, with a first side 21 and a second side 21 and a vertex 22 connecting the first side to the second side. The link can be inserted into and secured by an automobile trunk lock latch 51 which is located in the trunk body 61 as shown in FIG. 1. As shown in FIG. 3 the link can also be inserted into and secured by a latch 51' which is located in a trunk lid 62'.

The link is inserted into and secured by the latch in place of the strike 52 or 52' which is located in the trunk lid 62 or the trunk body 61'. Thus the link has a strike homolog, a strike homolog being an element which is generally equivalent to the shape and size of the strike and is generally equivalent in function to the strike so that the link is removably attachable to the lock latch in place of the strike in order to function in a manner generally equivalent to the function of the first strike. The sides 21 of the triangular link are each a strike homolog for many links and the acute angle vertices 22 are each a second strike homolog for other strikes. The link needs a strike homolog which is an acute angle vertex in order to fit into latches which are tightly recessed, typically in the trunk body 61 as shown in FIG. 1.

The strike homolog in link 20—a side 21 and alternatively a vertex 22—is thus integral to the periphery of the link. Because the strike homolog is integral to the periphery of the link, the new tie-down 10 is easy to manufacture and easy to use. Also, since the strike homolog is integral to the periphery of the link, the link does not interfere with the remotely controlled latch openers and latch sensors which ate now common.

In the preferred embodiment the link is bent from standard rod stock in three standard sizes having circular cross section diameters respectively of 0.0625 inches (1.588 mm), 0.1875 inches (4.763 mm), and 0.3 125 inches (7.938 mm). The vertices ate rounded in the bending, and the distance between vertexes is about 2 inches (50.8 mm). Links with these sizes have been found to fit nearly all currently manufactured automobiles. It would be equivalent to make a link with each of the sides 21 and each of the vertices 22 having respectively one of these sizes. Other shapes would be equivalent so long as they incorporate an acute angle vertex for trunk lock latches which require this shape strike homolog and incorporate a generally straight side for trunk lock latches which require this shape strike homolog.

A hook 40 has a bight 41 and a ting 42. The bight 41 can be removably attached to a trunk lock strike 52 or 52'. A strap 11 passes through the hook ring 42 so that the hook ring is attached to a loop 14 in the strap. A first cinch ring 31 and a second cinch ring 32 encircle through the link 20. The strap is adjustably attached to the link 20 through the cinch rings 31 and 32. This is best seen in FIG. 2 which shows how the strap first end 12 and the strap second end 13 pass together around the first cinch ring 31 and pass through the second cinch ring 32.

Lengths of the portion of the strap between the hook ring 42 and the cinch rings 31 and 32 can be adjusted by pulling the strap first end 12 and strap second end 13 together to pull the doubled strap through the cinch rings 31 and 32. When there is tension in the portion of the strap between the hook ring 42 and the cinch rings 31 and 32 then the strap will not slip through the cinch rings. The link, the hook, the strap, and the means for adjustably attaching the strap to the link are all very strong, very easy to manufacture, and very easy to adjust. The tie down can be adjusted by pulling on the strap ends in a direction away from the automobile, thus avoiding bruised knuckles in the process. The tie-down can be released from the latch by opening the latch. The tie down can be locked in place and released either with the lock key or by using the remote controlled trunk lock opener now commonly found in automobiles.

Other equivalent forms for the link, the hook, and the strap and other equivalent means for attaching and adjusting the strap will be obvious to people skilled in the art. It is understood therefore that this invention is not limited to the particular examples illustrated here.

I claim:

1. The in combination with an automobile trunk, the trunk having a trunk body, a trunk lid, and a trunk lock, the trunk lock having a lock latch and a lock strike, a trunk lock tie-down comprising:

a link, the link being generally in the form of a triangle, the triangle having a first side, a second side, and a vertex connecting the first side to the second side, the triangle first side being a first strike homolog so that the first side is removably attachable to the lock latch in place of the lock strike, the vertex being a second strike homolog so that the vertex is removably attachable to the lock latch in place of the lock strike;

a first cinch ring which encircles the vertex and a second cinch ring which encircles the vertex;

a strap, the strap being adjustably attached to the link around the first cinch ring and through the second cinch ring; and a hook attached to the strap, the hook having a bight which is removably attachable to the lock strike.

* * * * *